US005322018A

United States Patent [19]

Hadden et al.

[11] Patent Number: 5,322,018

[45] Date of Patent: Jun. 21, 1994

[54] SURFACE-INITIATING DEFLAGRATING MATERIAL

[75] Inventors: William C. Hadden, Springfield; Kenneth C. Puls, West Springfield, both of Mass.

[73] Assignee: The Ensign-Bickford Company, Simsbury, Conn.

[21] Appl. No.: 130,152

[22] Filed: Sep. 30, 1993

Related U.S. Application Data

[63] Continuation of Ser. No. 800,062, Nov. 27, 1991, abandoned.

[51] Int. Cl.[5] ..... F42B 1/00; C06D 5/06

[52] U.S. Cl. ..... 102/284; 102/289; 102/380

[58] Field of Search ..... 102/284, 289, 380, 531

[56] References Cited

U.S. PATENT DOCUMENTS

| | | | |
|---|---|---|---|
| 2,697,325 | 12/1954 | Spaulding | 102/380 |
| 3,000,308 | 9/1961 | Land et al. | 102/473 |
| 3,056,701 | 10/1962 | Fritzlen | 102/284 |
| 3,067,686 | 12/1962 | Coover et al. | 102/284 |
| 3,159,104 | 12/1964 | Hodgson | 102/284 |
| 3,163,113 | 12/1964 | Davis et al. | 102/284 |
| 3,176,618 | 4/1965 | Forsberg et al. | 102/284 |
| 3,213,793 | 10/1965 | Dratz | 102/284 |
| 3,276,373 | 10/1966 | Lyons | 102/275.1 |
| 3,496,870 | 2/1970 | Fulmer | 102/284 |
| 3,726,216 | 4/1973 | Calder, Jr. et al. | 102/275.8 |
| 3,763,787 | 10/1973 | Schultz | 102/284 |
| 3,995,559 | 12/1976 | Bice et al. | 102/284 |
| 4,013,743 | 3/1977 | Blasche, Jr. et al. | 102/284 |
| 4,036,138 | 8/1977 | Chopra et al. | 102/331 |
| 4,411,199 | 10/1983 | Yates et al. | 102/481 |
| 4,581,998 | 4/1986 | Horst et al. | 102/289 |
| 4,858,951 | 8/1989 | Lenzen | 102/531 |
| 4,917,017 | 4/1990 | Beltz | 102/470 |

*Primary Examiner*—David H. Brown

*Attorney, Agent, or Firm*—Victor E. Libert; Frederick A. Spaeth

[57] ABSTRACT

An igniter (18) provides rapid longitudinal and radial propagation of the ignition reaction. The igniter may comprise a pyrotechnic material and an inorganic binder, such as silica, carried on a carrier web (10) which may be fiber-glass. One or more layers of coated web (10) are disposed to provide an igniter (18) of cylindrical configuration and having a hollow core. The coated layers are permeable to the ignition reaction to facilitate radial propagation of ignition. The hollow core and the continuous nature of the pyrotechnic layers promotes longitudinal propagation of ignition. The igniter may consist mostly or entirely of inorganic materials to reduce or eliminate the formation of carbon monoxide upon ignition, and may be contained within a radially perforated sheath (20) to form a radial ignition device (25).

20 Claims, 2 Drawing Sheets

FIG. 6
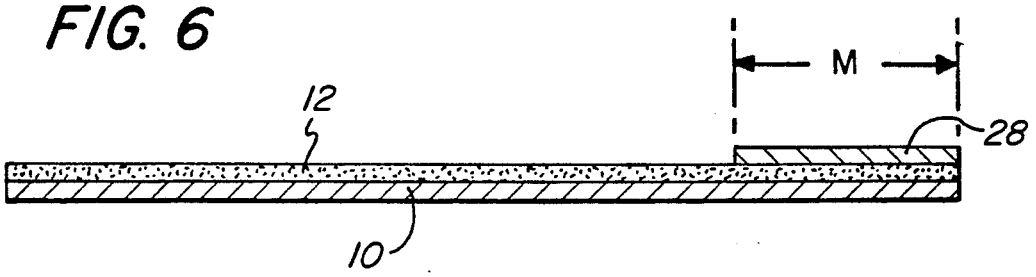
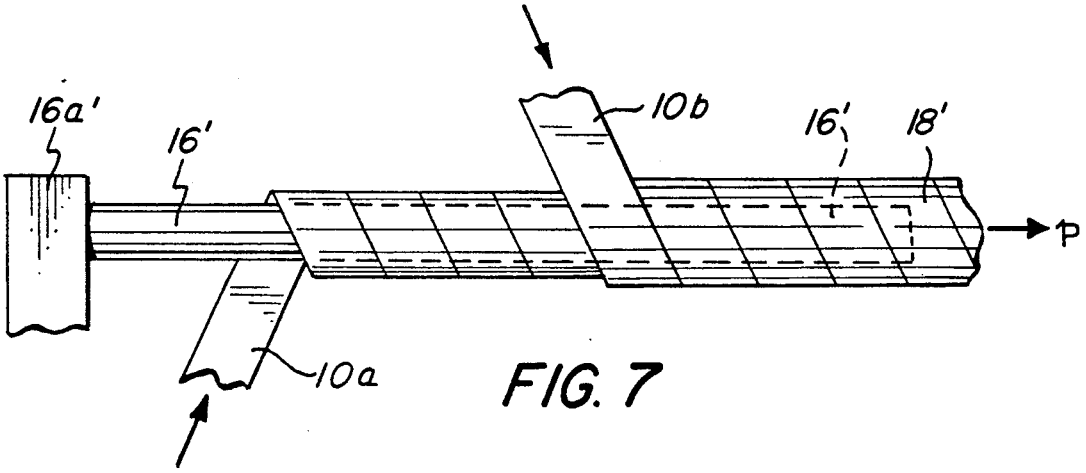
FIG. 7
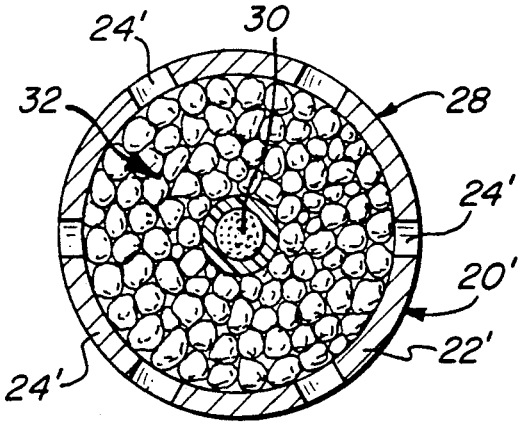
FIG. 8
(PRIOR ART)
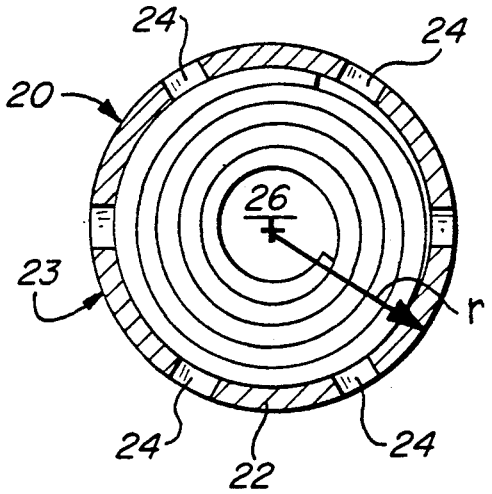
FIG. 3A

SURFACE-INITIATING DEFLAGRATING MATERIAL

This is a continuation of copending U.S. application Ser. No. 07/80,062 filed on Nov. 27, 1991, abandoned.

BACKGROUND OF THE INVENTION

1. Field of Invention

This invention relates to surface-initiating deflagrating materials and more specifically to elongate igniters which provide both longitudinal and radial output of the ignition reaction.

2. Related Art

U.S. Pat. No. 3,067,686 to Coover Jr. et al, dated Dec. 11, 1962, discloses a carpet-roll type propellant grain utilized for a rocket motor. The web is a fabric woven from strands of a poly-alpha-olefin, and serves as the reducing agent for the oxidant which may take different forms (column 4, lines 3–13) and which may be applied to the web in a mixture exemplified by a mixture of aluminum powder and ammonium perchlorate (Example 4, column 6). The outer windings of the web are uncoated (column 4, lines 38–47).

U.S. Pat. No. 3,763,787 to Schultz, dated Oct. 9, 1973, discloses a rocket propellant which may be a composite or modified double base propellant applied to a substrate screen. The substrate screen may be a fiberglass web (see column 2, lines 23–25). The propellant may include a fuel such as powdered aluminum, an inorganic oxidizer such as ammonium perchlorate and a rubberized binder (column 3, lines 25–29).

U.S. Pat. No. 3,213,793 to Dratz, dated Oct. 26, 1965, discloses a solid rocket propellant in which a cellulosic web which has been impregnated with an oxidizing agent is coated with a dispersion comprising a "fuel" (reducing agent) and an oxidant (column 1, lines 48–55). The web, which is highly absorptive and may be made from paper (column 1, line 70 to column 2, line 45), is dried and rolled to serve as a solid propellant charge. The oxidant initially impregnated into the web may be ammonium perchlorate (column 2, lines 46–52) and the fuel coating may comprise powdered aluminum as the reducing agent (column 3, lines 15–20) and an additional oxidizer (column 3, lines 15–17. See Example 1, especially column 6, lines 40–44).

U.S. Pat. No. 4,838,165 to Gladden et al, dated Jun. 13, 1989, discloses an igniter in which pyrotechnic material, which may be aluminum powder mixed with potassium perchlorate, is disposed within an elongate sheath.

SUMMARY OF THE INVENTION

Generally, the present invention provides an igniter which provides rapid radial and longitudinal propagation of the ignition reaction and which may be manufactured more economically and efficiently than prior art igniters. The reduced content of, or elimination of, carbonaceous materials in certain embodiments of the igniter of the present invention results in a reduction in the amount of, or precludes the formation of, carbon monoxide upon ignition.

In accordance with one aspect of the present invention, the igniter consists essentially of inorganic components comprising an inorganic carrier on which is coated a pyrotechnic material to provide a coated carrier. The pyrotechnic material comprises an inorganic reductant component and an inorganic oxidizer component.

According to one aspect of the invention, the igniter has a cylindrical configuration. In another aspect of the invention, the cylindrical configuration is defined by a plurality of radially disposed layers of the coated carrier.

Another aspect of the present invention provides that the igniter is configured to have a hollow core extending longitudinally through the igniter.

Yet another aspect of the present invention provides that the igniter may be of cylindrical configuration and comprises a carrier on which is coated a pyrotechnic material to provide a coated carrier. The pyrotechnic material comprises a reductant component and an oxidizer component. The cylindrical configuration of the igniter is defined by one or more radially disposed layers of the coated carrier, the layers being permeable to ignition of the pyrotechnic material, whereby ignition of the pyrotechnic material propagates both longitudinally and radially through the igniter.

In one aspect of the invention, the carrier may have a rolled, i.e., convolute configuration. Alternatively, the carrier may have a helical-wound configuration.

Other aspects of the invention are provided by the following features, one or more of which may be present in a given embodiment. The carrier may comprise a fiberglass web and the web may contain an inorganic sizing or a blend of organic and inorganic sizings; the pyrotechnic material may further comprise an inorganic binder, for example, colloidal silica. Thus, the pyrotechnic material according to the present invention may comprise from about 20 to 36% aluminum, from about 55 to 71% ammonium perchlorate, from 0 to about 30% potassium perchlorate and from about 2 to 5% binder by weight (dry basis) of the pyrotechnic material.

In another aspect, the present invention provides that the igniter may be combined with a radially perforated tubular sheath within which the igniter is disposed. The combination provides an ignition device. The sheath may be made of any suitable material, e.g., an inorganic material, preferably a metal such as steel.

As used herein and in the claims, the term "inorganic" has a broad meaning as indicating that branch of chemistry and chemical compounds other than hydrocarbons and their derivatives, i.e., all substances which are not compounds of carbon. Although some definitions of "inorganic" do not exclude carbon oxides and carbon disulfide, for purposes of this patent application, all carbon compounds capable of conversion to carbon monoxide upon ignition, and elemental carbon, are excluded from the definition of "inorganic".

As used herein and in the claims the term "organic" has its usual broad meaning as indicating that branch of chemistry and chemical compounds concerning hydrocarbons and their derivatives, i.e., all substances which are compounds of carbon.

Other aspects of the present invention are described below.

BRIEF DESCRIPTION OF THE DRAWINGS

FIG. 3A is a cross-sectional view, enlarged relative to FIG. 3, taken along line A—A of FIG. 3;

FIG. 6 is a schematic cross-sectional view of a web coated with pyrotechnic material having an applied mask portion as may be used in manufacturing an igniter according to one embodiment of the present invention;

FIG. 7 is a schematic elevational view of an alternate method of producing an igniter according to another embodiment of the present invention; and FIG. 8 is a view similar to that of FIG. 3A but of a prior art ignition device.

DETAILED DESCRIPTION OF THE INVENTION AND PREFERRED EMBODIMENTS THEREOF

Figure 1:
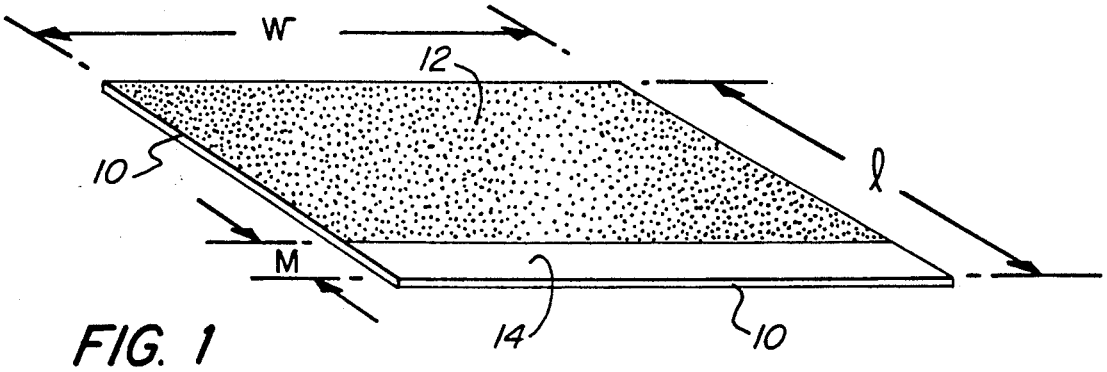
FIG. 1 is a schematic perspective view of a coated carrier web with an uncoated masked portion showing an early stage of manufacture of an ignition device according to one embodiment of the present invention.

The present invention provides an igniter which may be used in an ignition device to provide both a longitudinally and a radially emanating ignition reaction. Such devices are used to initiate the deployment of air bag inflators such as are used as automobile safety devices, to ignite the ejectors which release munitions from cruise missiles, in artillery as gun primers and in other explosives and pyrotechnic devices. The igniter of the present invention may be used in these and other applications to rapidly propagate an ignition reaction not only longitudinally along the length of the line, but radially outwardly of the line as well.

Generally, an igniter according to the present invention is prepared by coating a carrier web with a homogeneous layer of a pyrotechnic material, and rolling, winding or otherwise arranging the coated web, while its pyrotechnic coating is still wet or sufficiently flexible, into a cylindrical configuration having one or more radially disposed layers. As used herein and in the claims, a "radially disposed" layer or layers means that the layer is, or the layers are, disposed radially about the longitudinal axis of the cylindrical igniter, just as the wall of a tube or pipe is disposed radially about the longitudinal axis of the tube or pipe. The rolled, wound or otherwise arranged web may advantageously be configured to define a longitudinal hollow core extending the entire length of the igniter. Accordingly, one way to make the igniter is by winding the coated web about a mandrel, thereby forming the igniter as a hollow cylinder or tube and then removing the igniter from the mandrel (or the mandrel from the igniter), to provide a cylindrical, hollow core igniter, the diameter of the mandrel determining the diameter of the hollow core. The freshly formed igniter is then dried or allowed to dry to provide the finished igniter. Only a single layer of coated web may be rolled on itself to provide either a rod-like structure or, if a mandrel is used, to provide a structure which resembles a tube or pipe, the wall of which is provided by a single pyrotechnic-coated web. Usually however, a number of overlying layers of coated web will be used. In any case, the igniter may, if desired, be provided with a protective outer layer made of a suitable thin material such as cellulosic paper, a polymeric film or, if inorganic materials are to be used, fiberglass, fiberglass paper or aluminum foil. Whether or not a protective outer layer is used, those portions of the web which will form the interior hollow core of the finished igniter, and those portions which will form the exterior surface of the igniter, may be left uncoated or may be covered by a layer of suitable material so that the pyrotechnic material is not exposed on the exterior of the finished igniter or on the interior core (if the igniter is formed to have one) to a degree which will result in loss of the pyrotechnic material through abrasion ("dusting"). The igniter may be disposed within a perforated sheath or tube to form an ignition device, or put to other use. The freshly formed igniter may be placed within the sheath while the pyrotechnic material is still wet, and dried while inside the sheath. Pyrotechnic material which weeps through the web material may have an adhesive effect helping to fix the igniter in place within the sheath.

The carrier web material used in preparing the igniter according to this invention may be a woven or non-woven material which can be wound into a carpet roll-like configuration or can be helically wound, as will be described below. Further, the web is permeable to the ignition reaction of the pyrotechnic material, so that when pyrotechnic material disposed on one side of the web is ignited, the ignition reaction permeates the web to a degree sufficient to ignite pyrotechnic material disposed on the other side of the web. Preferably, the web is permeable to the coating of pyrotechnic material applied thereto so it "weeps" between web layers to bridge adjacent layers through the interstices of the web. Once ignited, the ignition reaction readily propagates both longitudinally along the continuously coated web surfaces, especially along the hollow core, and radially across the multiple layers of the web, if such are present. The permeability of the web permits the ignition reaction to readily propagate radially through the web or through radially disposed multiple layers of coated web, and longitudinally along the continuous coating or coatings of pyrotechnic material. When the igniter is configured to have a hollow core, longitudinal propagation is especially facilitated along the core.

The carrier web may advantageously be made of a primarily non-carbonaceous material, e.g., an inorganic material, which is permeable to the ignition reaction. Inorganic materials are preferred because of the resulting preclusion of carbon monoxide formation upon combustion, which is sometimes desired for reasons discussed below. Fiberglass cloth is a preferred web material because it is principally inorganic and the conventional carbonaceous additives (e.g., starch sizing) can be removed or replaced with inorganic species (as will be disclosed herein). Fiberglass fabrics may also be sufficiently porous to allow pyrotechnic material to lodge in the interstices of the cloth, thus facilitating the transfer of the ignition reaction through the cloth. However, non-woven fiberglass matting (or "fiberglass paper") may work as well, and when used, is preferably prepared with an inorganic sizing and in a thickness of from about 5 to 10 mils (0.127–0.254 mm). In addition, organic materials, such as cellulosic paper, or a polymeric material, may be used for the web in applications where a reduction or elimination of carbon monoxide release upon ignition is not required.

In a preferred embodiment, a conventional fiberglass web, whether non-woven or woven, is heat cleaned, i.e., calcined, to remove any starches or other carbonaceous species which may be present. It may then be treated with an inorganic sizing rather than a conventional carbonaceous sizing. The inorganic sizing may comprise silica and may be applied to the web as a water-based colloidal suspension. In an alternative embodiment, the sizing may comprise, in addition to silica, a quantity of a carbonaceous polymeric material such as acrylic resin, which releases less carbon monoxide upon burning than many other carbonaceous binders, and which improves handling characteristics, e.g., stiffness and weave set, of the carrier web. The acrylic may comprise from about 5 to about 30% by weight of the sizing material on a dry basis. The choice of acrylic material and the inclusion of an inorganic species in the sizing reduces the carbon monoxide production of this cloth in relation to conventional fiberglass cloth having primarily carbonaceous sizing. Preferably, the sizing comprises from about 3–6% by weight of the uncoated cloth.

A sized, uncoated fiberglass cloth carrier web having a conventional weave may have a typical thickness of about 2.3 mils (0.058 millimeters) and may be porous or perforated rather than smooth, to allow better adherence of the pyrotechnic material onto the web. This thickness allows the ignition reaction to pass through the web to ignite pyrotechnic material on the other side. Webs made from other suitable materials may likewise be dimensioned and configured to provide such permeability.

A coating material comprising a pyrotechnic material is applied to the carrier web. Ordinarily, a sufficient quantity of pyrotechnic material can be coated on a single side of the web, but it is possible, in alternative embodiments of the invention, to coat both sides of the web. The pyrotechnic material is chosen to be any material with suitable deflagration properties to serve the needs of the end use, and typically comprises a fuel comprising a reductant and an oxidizer. Various mixtures and preparations of reductants and oxidizers are known in the art; a mixture of aluminum particles, e.g., flake, ammonium perchlorate and, optionally, potassium perchlorate is a preferred pyrotechnic material. The aluminum flake employed may be of a size which is typical of the kind of flake used in aluminum paint, having a particle size distribution such that about 99% of the flakes pass through a standard 325 mesh screen. Preferably, sufficient pyrotechnic fuel is provided to allow the reaction between the reductant and oxidizer to be self-sustaining so that no additional source of fuel is needed. Therefore, the carrier need not be composed of a material which will serve as part of the fuel in the ignition reaction.

The pyrotechnic material may also include a binder to enhance the adhesion of the pyrotechnic material to the carrier web. In contrast to conventional binders, which typically comprise carbonaceous polymeric materials such as latex or other organic binders, the present invention makes use of a binder which is principally, and preferably entirely, composed of an inorganic material. Inorganic binders may be preferred over carbonaceous binders because they do not produce carbon monoxide when the pyrotechnic material is ignited. This is advantageous in a number of areas, for example, when the present invention is used as an igniter for automotive air bag inflators. In such use, it is desired to reduce the quantity of noxious gases such as carbon monoxide produced by the air bag inflator to protect the occupants of the automobile, who may be injured and unconscious, from exposure to carbon monoxide or other noxious gases released by the air bag device.

A preferred inorganic binder comprises colloidal silica, although other inorganic materials such as alumina may work as well. Preferably, the binder constitutes from about 2 to 5% by weight, dry basis, calculated as silica ($SiO_2$) of the pyrotechnic material, e.g., about 2.5% by weight. The colloidal silica is mixed into the liquid medium to prepare the coating material as described below.

The pyrotechnic coating material may be disposed in a liquid suspension known as a "wet mix" which is deposited upon the carrier web. The wet mix is a slurry of the pyrotechnic material and the binder in a liquid medium which is later removed (e.g., by drying) from the igniter. The liquid medium may comprise water and a wetting agent added to assist in dispersing the aluminum flakes or particles in the liquid medium. Any suitable wetting agent may be used, and among organic wetting agents, volatile compounds such as alcohols, which can later be removed from the web by evaporation, are preferred over conventional soap-type surfactants, which leave a carbonaceous residue. A typical liquid medium comprises from about 10 to 100% wetting agent by volume, for example, the liquid medium may comprise about 33% isopropyl alcohol by volume, the balance being water. Wetting agents comprising fluorinated hydrocarbons of the type sold under the trademark Freon by E.I. DuPont de Nemours and Company and which are liquid at ambient conditions may be used as, or as a component of, the liquid medium. The liquid medium may comprise from about 30 to 90% by weight of the wet coating material mix, for example, about 40 to 50%, e.g., 47%. The carrier web may be coated with the wet mix by any conventional method, e.g., by immersion of the web in a bath station containing the wet mix or by depositing the wet mix on the web and spreading the wet mix with a doctor blade, or by any other suitable methods. The pyrotechnic material may thus be coated upon one or both sides of the web. Due to the porosity of the carrier web, the application of the wet mix to one side of the web results in a wicking or weeping of the wet mix, including some pyrotechnic material, into the interstices of the cloth and, to a small extent, onto the opposite surface of the cloth. Diffusion of the pyrotechnic material through the entire thickness of the web in this way promotes radial permeability of the web to the ignition reaction by causing the pyrotechnic material in one layer of the multiple ply igniter to bridge the web thickness to contact the pyrotechnic material in each radially adjacent layer. The bridging of the web layers by the pyrotechnic material insures that the ignition of one layer of material will ignite the radially adjacent layer, to provide reliable radial, as well as longitudinal, propagation of the ignition reaction. The "weep-through" of a wet mix applied only to one side of the web does not deposit nearly as much pyrotechnic material on the opposite surface of the web as is disposed on the coated surface but a sufficient amount of binder weeps through the cloth to help bind adjacent windings of the web together when the igniter is dried, as will be described below. Thus, the uncoated surface can be considered as being effectively "masked" or free of pyrotechnic material as described herein. One-sided coating of the web is preferred as being a simpler manufacturing procedure. To provide additional protection against the loss of pyrotechnic material, the igniter may, as noted above, optionally be wrapped with thin aluminum foil or a similarly suitable covering.

Typically, the wet mix contains enough pyrotechnic material to provide about 1 gram of pyrotechnic material (dry basis) per linear inch (0.394 gram per linear cm) of the finished igniter. After the wet mix is applied to the web, the web may be partially dried to remove some, but preferably not all, of the liquid medium of the wet mix, because the handling characteristics of the web in the wet state are preferred to those of a dry-coated web. When dry, the pryotechnic material is brittle, and subsequent handling is difficult and leads to loss of pyrotechnic material, referred to as "dusting". In addition, dry pyrotechnic material may be susceptible to accidental ignition from static electricity which is often produced in handling web materials.

To produce an ignition device according to the present invention, the wet-coated carrier web may be disposed in a configuration having one layer or a plurality of concentric, radially disposed layers to form an igniter by, for example, winding the web around a mandrel. The wound web is removed from the mandrel, leaving an open, longitudinally extending hollow interior core in the igniter. The carrier is thus disposed in a "carpet roll" configuration, referred to herein and in the claims as a "convolute" configuration. Winding the coated web in a convolute configuration disposes one layer upon the next in radial succession, beginning with an innermost winding and ending with an outermost winding.

A section of the carrier web corresponding to the outer surface of the outermost winding of the igniter is masked so that pyrotechnic material is not prominently exposed on the outer surface of the igniter. Likewise, another portion of the carrier material is masked so that, upon removal of the mandrel, pyrotechnic material is not exposed to the open interior core of the igniter. Masking may be accomplished by providing an uncoated portion of the exposed surface of the carrier web or by affixing a swatch of a suitable material over a coated portion of the carrier web to cover the coated areas which are to be masked. When a web is coated on one side only, the entire uncoated side of the web can be considered to be masked, and part of the masked side will be exposed as the surface of the inner core or as the outer surface of the igniter. The result of masking is that the pyrotechnic material is protected from dusting, i.e., from having particles of the pyrotechnic material dislodged from the exterior surface or from the interior hollow core.

The igniter may be inserted into a radially perforated tubular sheath to form an ignition device. After the igniter is disposed within the sheath, the igniter is dried to remove the remaining liquid medium. Upon drying, the pyrotechnic material fuses adjoining windings of the carrier web (if such there be) into an integral structure, those portions of the wet mix which wept through the web thickness serving to secure adjacent layers together. In addition, drying fixes the wound igniter within the sheath because the binder which wept through the outermost winding of the web contacts the interior surface of the sheath.

The sheath is preferably formed from inorganic material and may be of any suitable cross section such as circular, ovoidal or polygonal cross section. In addition to an axial opening at one or each longitudinal end of the tubular sheath, the wall of the sheath has perforations formed therein (radially through the wall) to allow the ignition reaction of the pyrotechnic material to spread radially outwardly of the sheath once the ignition device is ignited. The wall of the sheath, where it is not perforated, contains the ignition reaction of the pyrotechnic material, thus preventing the energy of the deflagration reaction from being excessively dissipated. Preferably, the sheath is made from an inorganic material, typically, steel.

The sheath should be sufficiently strong to withstand the deflagration of the igniter without being ruptured. Therefore, as is known in the art, the size and number of perforations must be chosen to balance mechanical strength of the sheath with the need to provide radial propagation of the ignition reaction without allowing the energy of the reaction to dissipate excessively. The perforations may be conventionally circular, or may have any other geometric configuration.

As noted above, a preferred embodiment of the present invention makes use of materials which, upon ignition of the igniter, produce no carbon monoxide or less carbon monoxide than ignition devices of the prior art. For this reason, the web material, the pyrotechnic material and the sheath are, preferably, each composed of inorganic material, or at least contain less organic material, i.e., carbonaceous matter, than conventional ignition devices. As discussed with respect to the sizing, a limited amount of carbonaceous material may be incorporated into the present invention, if necessary or convenient, without defeating the overall benefit of reduced carbon monoxide production. As discussed above, there are uses of the present invention in which carbon monoxide production is not viewed as a problem, so that carbonaceous components may be used without constraint.

In a specific embodiment, pyrotechnic material is mixed with an inorganic binder in a liquid medium to produce a wet mix. The pyrotechnic material comprises a fuel comprising a reductant such as flaked aluminum and an oxidizer such as ammonium perchlorate and, optionally, potassium perchlorate, in amounts which favor high energy output and a fast deflagration rate. A preferred mixture comprises 7% potassium perchlorate, 61.5% ammonium perchlorate, 29% aluminum flake and 2.5% colloidal silica by weight, in a liquid medium comprising 33% isopropyl alcohol and 67% water, by volume of the liquid medium. The solids content of the wet mix is about 47% by weight.

Figure 2:
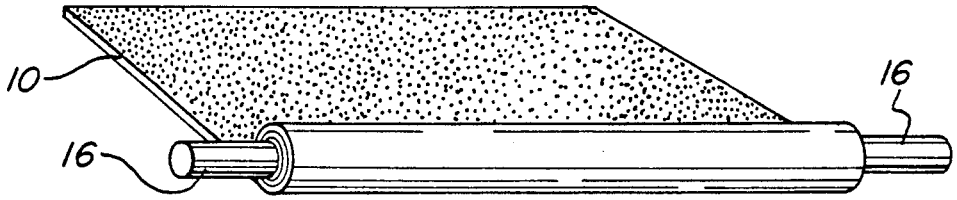
FIG. 2 is a schematic perspective view of the carrier web of FIG. 1 in a later stage of manufacture, being wound about a mandrel in a convolute configuration.
Figure 3:
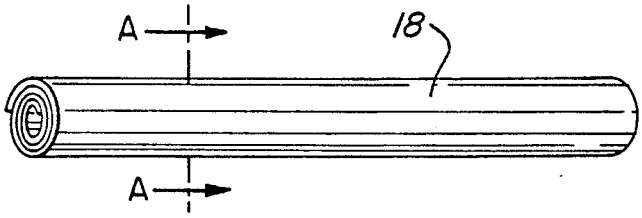
FIG. 3 is a perspective view of the igniter according to one embodiment of the present invention obtained by carrying out the steps illustrated in FIGS. 1 and 2.

Referring now to FIG. 1, a web 10 of fiberglass cloth prepared with an inorganic sizing and measuring about 8.5 inches (21.6 cm) in length l and from about 5.7 inches (14.5 cm) to about 10.3 inches (26.2 cm) in width w, for example, 8.3 inches (21.1 cm) wide, is placed on a flat surface (not shown) and a quantity of the wet mix is placed thereon and spread over the surface of web 10 using a doctor blade or other suitable device (not shown) to provide a pyrotechnic material coating 12. The coating procedure is conducted to deposit sufficient pyrotechnic material to provide about 1 gram (dry basis) of pyrotechnic material per linear inch (0.39 g per linear cm) of the finished igniter. One edge portion of web 10 provides a masked region 14 having a width M of about 1 inch (2.5 cm). While the pyrotechnic material coating 12 is still damp, coated web 10, as schematically illustrated in FIG. 2, is wound around a mandrel 16 with the uncoated side of web 10 being disposed outwardly of the igniter being formed on the mandrel. Mandrel 16 may typically have a diameter of about 0.27 inches (0.68 cm). The rolled-up carrier web may typically have an outer diameter of about 0.43 inches, (1.1 cm). Masked region 14 is the first part of web 10 which is wound about mandrel 16, to provide the innermost winding and to assure that little pyrotechnic material will come into contact with mandrel 16 or will be exposed to the interior core when the igniter is later removed from mandrel 16. The remainder of web 10 is wound in successive layers on top of the innermost winding until a last, outermost winding is made, forming the igniter 18 (FIG. 3). Since the coated side of web 10 was disposed inwardly during winding, the outermost winding is disposed with the uncoated side of web 10 providing the exterior surface of igniter 18.

Figure 4:
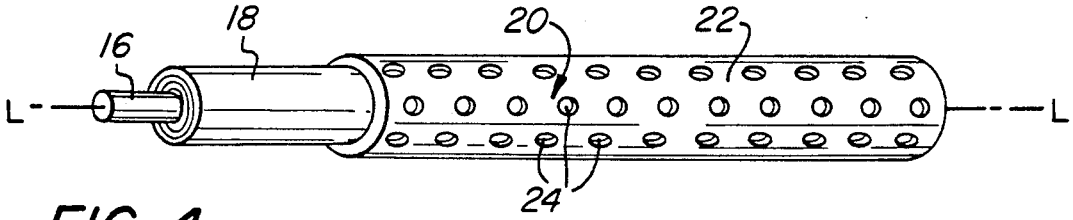
FIG. 4 is a perspective view of the finished igniter formed as illustrated in FIGS. 1 and 2 being inserted into a perforated tube.
Figure 5:
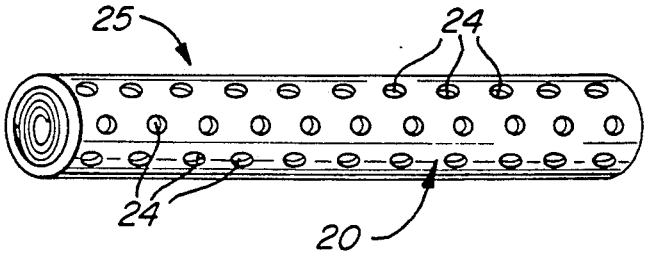
FIG. 5 is a schematic perspective view of an ignition device in accordance with one embodiment of the invention obtained by carrying out the step illustrated in FIG. 4.

As illustrated in FIG. 4, the mandrel 16 carrying web 10 now having been wound into a rolled convolute configuration to provide an igniter 18, is inserted into a perforated tube or sheath 20 from an end opening thereof. Sheath 20 has a longitudinal axis L—L and is comprised of a sheath wall 22 having formed therein a plurality of radial perforations 24. Sheath 20 may be made from any suitable material, e.g., steel, and may have an inner diameter of, e.g., 0.5 inches (1.3 cm) and an outer diameter of about 0.562 inches 1.4 cm). A plurality of pyrotechnic-coated layers of web 10 is thus disposed radially along radius r (FIG. 3A) of igniter 18. Once igniter 18 is fully inserted within sheath 20, mandrel 16 is removed, leaving sheath 20 behind. The igniter 18, encased within sheath 20, is then dried to evaporate the liquid medium from pyrotechnic material wet mix 12 and provide the ignition device 25 (FIG. 5). Drying of pyrotechnic material wet mix 12 fuses the individual windings of web 10 together and binds igniter 18 within sheath 20 to produce an ignition device 25 (FIG. 5) according to an embodiment of the present invention and having a plurality of radially disposed layers and a longitudinally extending hollow core 26 (FIG. 3A). As well known to those skilled in the art, sheath 20 is adapted to receive at one end thereof an explosive squib or other suitable device (not shown) which is positioned against or in proximity to one end of igniter 18 and is used to ignite the ignition device.

In another embodiment of the present invention, the entire surface of web 10 may be coated with a wet mix of pyrotechnic material 12, as shown in FIG. 6, without leaving a masked area corresponding to area 14 of FIG. 1. In such case, a ribbon of mask material 28 is applied along one or both edges of the coated web to provide a masked region of width M. Mask material 28 is preferably an uncoated ribbon of the same material as web 10. Alternatively, the mask material may be a sheet of thin aluminum foil or a similarly suitable covering.

An alternative method of producing an ignition device having a plurality of concentric radially discrete layers of a coated carrier web is illustrated in FIG. 7. According to this method, a first ribbon of pyrotechnic material-coated carrier web **10*a* is wound in a helical fashion about a mandrel 16' which is carried on a support 16*a*'. While adjacent windings of web 10*a* may overlap each other, they are preferably disposed in a butt-seamed configuration so that coated web 10*a* lies in a continuous, single radial layer of uniform thickness. The interior surface of web 10*a* is free of pyrotechnic material, web 10*a* having a coating of pyrotechnic material only on the outward-facing surface thereof wound upon mandrel 16'. Optionally, one or more additional radial layers of pyrotechnic material-coated carrier web 10*b* are similarly wound around mandrel 16', the second layer being applied on top of web 10*a* and subsequent ones on top of each preceding layer. The outermost winding of web material, provided in the illustrated embodiment by web 10*b*, is free of a pyrotechnic material coating, at least on its outwardly-facing surface and may comprise a protective outer layer as described above with reference to the embodiment of FIGS. 3 and 8. The helically-wound webs provide an igniter. 18' which is fed off mandrel 16' continuously, as indicated by arrow p, as it is produced. The directions of travel of webs 10*a* and 10*b* are indicated by the arrows associated therewith. Lengths of igniter 18'** can be stored or cut to length before being dried, or may be passed directly to an oven for drying and subsequent processing, as desired.

A cross-sectional view of a conventional prior art ignition device 28 is illustrated in FIG. 8 in a view corresponding to that of FIG. 3A showing an embodiment of the present invention. The prior art device comprises a detonating cord 30 disposed within a radially perforated (perforations 24') tubular sheath 20'. Detonating cord 30 is packed within a longitudinal granular bed 32 of a relatively stable pyrotechnic charge, e.g., $BKNO_3$. Conventional pyrotechnics such as granular bed 32 do not linearly propagate fast enough to provide uniform radial output along the length of the igniter, thereby requiring that the presence of detonating cord 30 to ignite granular bed 32. A detonator or squib (not shown) is positioned to ignite detonating cord 30, which in turn releases sufficient energy to ignite the more stable pyrotechnic granular bed 32. So configured, ignition device 28 of the prior art suffers from several significant disadvantages. First, it is difficult, time-consuming and expensive to manufacture compared to the igniters of the present invention because the cord 30 must be embedded within the granular bed 32 and accurately centered therein. If detonating cord 30 is not accurately centered, uniform radial deflagration of granular bed 32 will not be attained. Accurate centering can be accomplished, for example, by accurately centering the detonating cord 30 within the perforated sheath 20' and, while holding its centered position, filling the remaining volume of sheath 20' with the granular pyrotechnic material. In addition to manufacturing difficulties, special provisions must be made to prevent the pyrotechnic material of granular bed 32 from escaping from ignition device 28 through the perforations 24' in the sheath 20' during manufacture and handling. This requires the use of a barrier layer (not shown) on the inner surface of perforated sheath 20' or other expedients. In addition, detonating cord 30 provides a very small target for a squib or other detonator. Since detonating cord 30 is so highly reactive, it cannot be made significantly bigger in diameter because upon ignition it could rupture the ignition device and disperse the granular bed 32 without igniting it.

An igniter according to the present invention, e.g., used in ignition device 25, overcomes the aforesaid problems of the prior art. As previously described, igniter 18 is easily manufactured with masked surfaces forming its hollow core 26 and its outermost surface, which reduces dusting because relatively little, if any, pyrotechnic material is disposed directly upon the exposed surfaces. Further, since the concentric, radially disposed layers of the carrier web are radially permeable to the ignition of the pyrotechnic material disposed thereon, the initial ignition of any part of the cross-sectional area of igniter 18 will serve to initiate and propagate the pyrotechnic action both longitudinally and radially. Therefore, an initiator may effectively ignite any part of the axial end of igniter 18 and therefore need not be designed to such stringent specifications as prior art devices. Thus, the reliability of the igniter is improved and the cost of its manufacture reduced. When the exposed interior surface is ignited, the ignition reaction proceeds along the interior surface of the igniter at a rate much faster than the rate of radial propagation. It is preferred, but not necessary, to ignite the igniter as close to its center or the interior core surface as possible, so that the slower radial propagation is initiated from the center or interior core surface. The rapid longitudinal propagation provides radial propagation nearly concurrently along the length of the relatively short igniter. The rate of radial propagation increases smoothly as the internal pressure of the igniter rises due to the burning pyrotechnic material. The use of a sheath such as illustrated sheath 20 is optional, as the igniter may be used without the sheath in certain applications.

While the invention has been described in detail with reference to a particular embodiment thereof, it will be apparent that upon a reading and understanding of the foregoing, numerous alterations to the described embodiment will occur to those skilled in the art and it is intended to include such alterations within the scope of the appended claims.

What is claimed is:

1. An igniter consisting essentially of inorganic components comprising an inorganic carrier on which is coated a pyrotechnic material to provide a coated carrier, the pyrotechnic material comprising an inorganic reductant component, an inorganic oxidizer component and an inorganic binder.

2. The igniter of claim 1 wherein the carrier comprises a fiberglass web.

3. The igniter of claim 1 wherein the inorganic binder comprises colloidal silica.

4. The igniter of claim 1 wherein the pyrotechnic material comprises from about 20 to 36% aluminum, from about 55 to 71% ammonium perchlorate, from 0 to about 30% potassium perchlorate, and from about 2 to 5% binder, all by weight of the pyrotechnic material.

5. The igniter of claim 1 having a cylindrical configuration.

6. The igniter of claim 2 wherein the cylindrical configuration is defined by a plurality of radially disposed layers of the coated carrier.

7. The igniter of claim 2 configured to have a hollow core extending longitudinally through the igniter.

8. The igniter of claim 1 in combination with a radially perforated tubular sheath within which the igniter is disposed.

9. The igniter of claim 8 wherein the pyrotechnic material further comprises an inorganic binder.

10. The igniter of claim 8 wherein the carrier comprises a fiberglass web.

11. The igniter of claim 10 wherein the fiberglass web contains an inorganic sizing.

12. An igniter having a cylindrical configuration comprising a carrier on which is coated a pyrotechnic material to provide a coated carrier, the pyrotechnic material comprising a reductant component and an oxidizer component, the cylindrical configuration of the igniter being defined by one or more radially disposed layers of the coated carrier, the layers of the coated carrier being sufficiently porous to be permeable to ignition of the pyrotechnic material, whereby ignition of the pyrotechnic material propagates both longitudinally and radially through the igniter.

13. The igniter of claim 12 configured to have a hollow core extending longitudinally through the igniter.

14. The igniter of claim 12 wherein the pyrotechnic material comprises from about 20 to 36% aluminum, from about 55 to 71% ammonium perchlorate, from 0 to about 30% potassium perchlorate, and from about 2 to 5% binder, all by weight of the pyrotechnic material.

15. The igniter of claim 12 in combination with a radially perforated tubular sheath within which the igniter is disposed.

16. The igniter of claim 12 wherein the carrier comprises a fiberglass web.

17. The igniter of claim 16 wherein the fiberglass web contains an inorganic sizing.

18. An igniter consisting essentially of inorganic components and an organic sizing as defined below, and comprising a carrier containing a blend of inorganic and organic sizings on which is coated a pyrotechnic material to provide a coated carrier, the pyrotechnic material comprising an inorganic reductant component and an inorganic oxidizer component; wherein the organic sizings consist essentially of an acrylic resin and comprise from about 5 to 30% by weight of the total weight of inorganic and organic sizings.

19. The igniter of claim 18 wherein the carrier comprises a fiberglass web.

20. An igniter consisting essentially of inorganic components and a limited amount of an organic sizing as defined below, the igniter comprising an inorganic carrier on which is coated a pyrotechnic material to provide a coated carrier, the pyrotechnic material comprising an inorganic reductant component and an inorganic oxidizer component, and the sizing is present in an amount of from about 3 to 6% by weight of the unsized carrier and comprises a combination of an inorganic sizing and an organic sizing comprising a carbonaceous polymeric material.

* * * * *

UNITED STATES PATENT AND TRADEMARK OFFICE

CERTIFICATE OF CORRECTION

PATENT NO. : 5,322,018

DATED : June 21, 1994

INVENTOR(S) : William C. Hadden et al

It is certified that error appears in the above-indentified patent and that said Letters Patent is hereby corrected as shown below:

In line 5 of the Abstract, "fiber-glass" should read --fiberglass-- .

In column 1, line 6, the serial number should read --07/800,062-- .

In column 7, line 24, insert a comma after "extending" .

In column 10, line 9, delete the period.

In column 11, line 47, , "of claim 2" should read --of claim 5-- ; and in line 50, claim 2" should read --of claim 5-- .

In column 12, claim 18, line 39, "sizings consist" should read --sizing consists-- ; "comprise" should read --comprises-- ; in claim 20, line 46, "an inorganic" should read --a sized inorganic-- ; and in line 50, "and" should read --wherein-- .

Signed and Sealed this

Twenty-ninth Day of August, 1995

*Attest:*

Bruce Lehman

BRUCE LEHMAN

*Attesting Officer*

*Commissioner of Patents and Trademarks*